US005927798A

United States Patent [19]

Ahn

[11] Patent Number: 5,927,798

[45] Date of Patent: Jul. 27, 1999

[54] CONVERTIBLE CHAIR AND BACKPACK

[76] Inventor: David G. Ahn, P.O. Box 441403, Aurora, Colo. 80044-1403

[21] Appl. No.: 08/935,788

[22] Filed: Sep. 23, 1997

Related U.S. Application Data

[60] Provisional application No. 60/025,310, Sep. 24, 1996.

[51] Int. Cl.[6] ..... A47C 13/00

[52] U.S. Cl. ..... 297/129; 297/52; 297/188.01; 297/53

[58] Field of Search ..... 297/52, 129, 118, 297/17, 188.01, 188.02, 53; 224/153, 155, 156, 633, 634

[56] References Cited

U.S. PATENT DOCUMENTS

| | | | |
|---|---|---|---|
| 1,113,573 | 10/1914 | Notman | 297/52 |
| 2,843,185 | 7/1958 | Clem . | |
| 3,077,327 | 2/1963 | Batie et al. | 297/188.01 |
| 4,103,965 | 8/1978 | Engman | 297/52 |
| 4,300,707 | 11/1981 | Kjaer . | |
| 4,387,924 | 6/1983 | Fernandez . | |
| 4,489,866 | 12/1984 | Korte . | |
| 4,676,548 | 6/1987 | Bradbury . | |
| 4,773,574 | 9/1988 | Burgard . | |
| 5,297,708 | 3/1994 | Carpenter . | |
| 5,538,318 | 7/1996 | MacLean . | |
| 5,722,717 | 3/1998 | Rettenberger | 297/52 |

FOREIGN PATENT DOCUMENTS

| | | |
|---|---|---|
| 197550 | 5/1958 | Austria . |

*Primary Examiner*—Peter M. Cuomo
*Assistant Examiner*—Anthony D. Barfield
*Attorney, Agent, or Firm*—Kyle W. Rost

[57] ABSTRACT

In a combined backpack and folding chair, the chair has a camp stool base frame. A pivoting backrest is held in upright position on the stool frame by in-turned, truncated ends at the bottom of a backrest frame, which strike the camp stool frame. Alternatively, the backrest frame has a continuous bar at its bottom, which strikes the camp stool frame. The backpack is offset from the chair by clearance established in the dimension of a bridge between the backpack and chair. The in-turned ends clear the backpack by a lateral distance, by-passing the sides of the backpack. The continuous bar clears the backpack by a longitudinal distance, by-passing the rear face of the backpack.

11 Claims, 2 Drawing Sheets

CONVERTIBLE CHAIR AND BACKPACK

CROSS REFERENCES TO RELATED APPLICATIONS

This application is a continuation-in-part of United States Provisional Patent Application No. 60/025,310, filed Sep. 24, 1996.

TECHNICAL FIELD

The invention generally relates to package and article carriers in which the carrier is convertible to or useable as a different device or different type of carrier. More specifically, the invention relates to a backpack or component thereof, especially to a folding stool. Still more specifically, the invention relates to a backpack that forms a seat or component thereof. In the alternative, the backpack forms a bed or litter or a component thereof. The invention also generally relates to chairs and seats, especially to those that are convertible to a non-occupant support device. Disclosed is lightweight backpack and chair combination. A chair with supporting backrest in one unit converts to either a chair or a backpack, as desired.

BACKGROUND ART

Outdoor backpacks, folding chairs, and chairs with a storage bag in separate units are used in camping and outdoor activities. Yet, when camping and hiking, transporting a chair is cumbersome even if the chair can be strapped to a backpack. Small camping stools, as sometimes are combined with a backpack, lack a backrest and thus are not comfortable for extended use. The use of such stools can strain the back after lengthy periods of sitting, especially when used by people with back problems. Hence, the combination of a chair having back support and a backpack is desirable and several such combinations have been attempted.

The unsolved problems in the art fall into two interrelated areas. First, viewed from the perspective of a good chair, the art lacks a combined backpack and chair structure that provides an adequate backrest when the combination is deployed in seating configuration. The difficulty is that the backpack component and the chair backrest component suffer physical interference with each other during deployment or storage of the chair. As a result, the most common approach in the art is to eliminate any backrest. Other approaches are to provide a backrest that is fixed and does not store or one that must be removed for storage, or one that is compromised in function and seating position. Second, viewed from the perspective of a good backpack, the art lacks a combination in which the stored chair contributes to the comfort, efficiency and load carrying ability of the backpack.

In prior combinations of a chair and backpack, the chair design falls into either of two general groups. One group uses a camp stool base, having a typical scissors or X-frame. The open position of a camp stool is defined and limited by a fabric seat connecting the ends of the frame members, which seat is placed in tension when the stool is opened and in use. When the camp stool is stored, the frame closes to a planar position and the fabric seat is relaxed and folded between the frame members. The second group uses a parallelogram frame, in which the fabric chair seat is carried in its own frame and is in tension regardless of whether the chair is deployed. The chair legs both pivot separately with respect to the seat and store in an approximately flat or planar storage position.

In the first group, U.S. Pat. No. 4,387,924 to Fernandez discloses a basic camp stool having both the seat fabric and a backpack attached to the top of the frame. U.S. Pat. No. 2,843,185 to Clem et al shows a camp stool with its seat sewn to the backpack.

U.S. Pat. No. 4,773,574 to Burgard discloses a camp stool base with a removable backrest pinned to each side of the base. In order to store the backrest, it must be removed and then can be inverted and re-installed on the base for compact carrying. Austrian Patent 197,550 to Johansson shows a camp stool and attached backpack, in which tray is pivoted to one frame member.

U.S. Pat. No. 4,489,866 to Korte varies the stool structure by providing one frame member longer than the other, supporting a fabric seat as a loose sling running front to back, providing a recliner style chair. The backpack hangs from the top of the longer frame member and serves as a pillow when the chair is in reclined position. Because the seat fabric is not in tension to limit the open position of the chair frame, Korte requires braces that interconnect the frame members and control the degree of opening. This sling style chair primarily is suited for lounging or sleeping but does not provide back support for typical upright seating, such as for eating.

In the second group of patents, the chairs resemble common folding lawn chairs. In U.S. Pat. No. 4,300,707 to Kjaer, the seat and front leg are parts of a single rigid frame that cannot fold into a planar position. The rear leg and backrest are a second frame, pivoted to the first frame. When this chair is folded and combined with a backpack, the front leg protrudes rearwardly and serves as a shelf that supports the backpack. U.S. Pat. No. 5,538,318 to MacLean shows a folding lawn chair that has attachments on the standard backrest for optional connection to a backpack. U.S. Pat. No. 5,297,708 to Carpenter uses a standard folding lawn chair to which is added a cargo platform. These lawn chairs are only marginally integrated with a backpack and are not parts of an efficient combination. U.S. Pat. No. 4,676,548 to Bradbury shows such a folding chair with a backpack on the back face of the backrest. This chair design will tip backwards when the backpack is weighted, and in backpack mode the chair frame applies unprotected metal frame members against the user's back.

The chief shortcoming of the art is the lack of an efficient system for transforming the combination of backpack and chair with backrest between seating mode and backpack mode. A related shortcoming is the lack of a compact package, wherein in seating mode the chair provides an upright back support for seating, and in backpack mode the chair aids in supporting the backpack for transport. When used in seating mode, the chair should provide an upright back support useful to brace the back, for example, during eating or a card game. Stools, sling chairs or recliner chairs, as found in prior art, are not well suited for this type of usage. Specifically, they lack good support in the backrest, and they convert awkwardly between seating mode and backpack mode.

When the chair is being struck or deployed, the transition should be smooth and not require disassembly or reassembly of the chair itself or of the combined chair and the backpack. A camp stool without a backrest can transition easily, but a backrest and backpack tend to interfere with each other. Until now, such interference has prevented a permanently assembled combination of lawn chair with backrest and a backpack.

When the backpack and chair is used in backpack mode, it would be desirable for the chair to provide further useful support for the backpack at the base of the combination. A single frame can serve both the backpack and the chair, in respective backpack mode and seating mode, offering an advantage in reduced weight, reduced bulk, and increased convenience. It would be especially desirable to have a chair and backpack combination that provides a chair with a comfortable backrest for back support when deployed. Correspondingly, it would be desirable for the backrest to provide back support when struck and used in backpack mode. The use of the backrest to provide such back support is especially desirable, since in an efficient camp chair, the backrest is likely to be the only portion of the lightweight chair structure provided with padding or cushioning.

To achieve the foregoing and other objects and in accordance with the purpose of the present invention, as embodied and broadly described herein, the combined chair and backpack of this invention may comprise the following.

DISCLOSURE OF INVENTION

Against the described background, it is therefore a general object of the invention to provide an improved backpack and chair with backrest. When converted into backpack mode, such a combination unit offers the advantage of being a backpack, transportable on a user's back or hand carried. Thus, the combination offers at least five integrated functions: it provides a chair, a back support rest, a backpack, instant conversion to chair or backpack, and a hand carrying handle in one unit.

A further object it to provide a backpack and chair unit that integrates the structural and functional members of each to provide a lightweight, strong, and efficient structure suited for seating as well as for carrying, such as for camping and hiking.

Additional objects, advantages and novel features of the invention shall be set forth in part in the description that follows, and in part will become apparent to those skilled in the art upon examination of the following or may be learned by the practice of the invention.

According to the invention, a convertible chair and backpack combines a backpack with a chair that is convertible between a seating configuration and a backpacking configuration. A bridge connects the backpack and chair. The chair provides a seat on a base frame that is moveable between a collapsed configuration suitable for backpacking and a deployed configuration suitable for seating. A chair backrest frame is connected to the base frame on a pivot axis for movement between an upright position for seating and a downward position for backpacking. A stop limits upward movement of the backrest frame with respect to the base frame at an upright seating position. The stop is positioned offset from the backpack by a sufficient distance that the backrest frame can pivot without substantial interference with said backpack.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
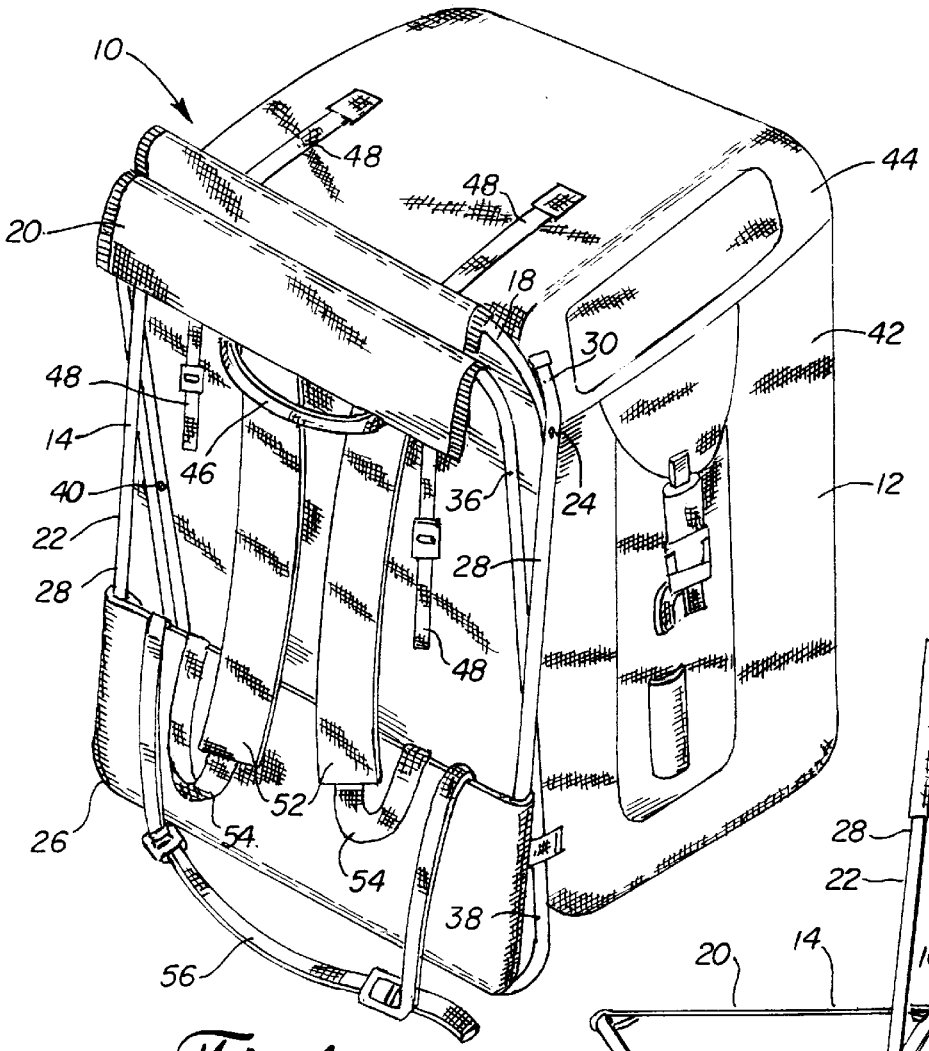
FIG. 1 is an isometric view of a first embodiment of the combined chair and backpack, showing backpacking configuration

The invention is a lightweight backpack and seating chair combination 10 with a supporting backrest. The chair and backpack have both seating use and backpacking use, with the chair having a convertible configuration to enhance each type of use. Thus, with reference to FIGS. 1 and 2, the primary components are a backpack 12 and a foldable, convertible chair 14, which are connected by a bridge 16. This combination may be configured as a backpack, shown in FIGS. 1 and 3, or as a chair, shown in FIGS. 2 and 4.

The chair 14 a lightweight folding or collapsing chair. It is provided with a base frame 18 that carries a seat 20. The base frame 18 supports a chair backrest frame 22 joined to the base frame on a pivot axis 24, which may be, for example, a rivet, pin, screw, bolt, axle or the like. The frame 22 carries a backrest cushion 26 near the upper end of the frame, as viewed in FIGS. 2 and 4. The configuration of the frame 22 includes a pair of elongated side members or standards 28, which are joined by a common top bar contained within the cushion 26, thereby defining at least a three sided frame. The cushion may include a pad looped over the top bar of the backrest to cushion both front and rear sides of the top bar, and covered by a fabric hood. Each side member 28 is located on an opposite lateral side of the chair base frame 18 and extends at least between the pivot axis 24 and the backrest cushion 26.

Figure 2:
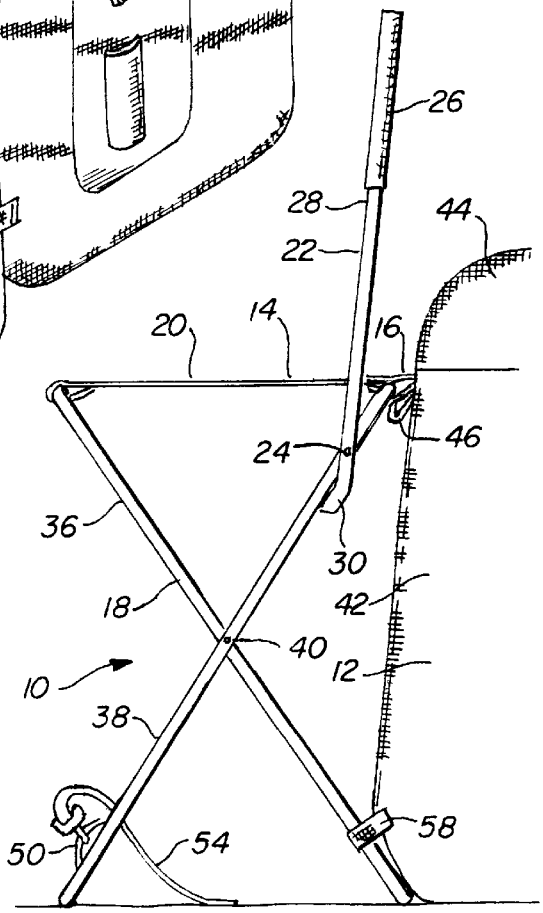
FIG. 2 is a side elevational view of the combined chair and backpack of FIG. 1, showing seating configuration.

The pivot axis is generally near the rear of the chair, shown to the right in FIG. 2, while the front of the chair is shown to the left. From this perspective, the backrest frame is selectively pivotable through an arc in which the cushion 26 passes around the front edge of the chair seat 20. The backrest may be pivoted to an upright position for seating, as shown in FIG. 2; or it may be pivoted to a downward position for backpacking, as shown in FIG. 1.

The upright position of the backrest frame 22 is established by a means stopping or limiting the upward pivotal movement of the backrest frame with respect to the base frame at the upright seating position. A stop means is connected to each side member 28 and in preferred position is on the opposite side of the pivot axis 24 from the backrest cushion 26. Further, the stop means is positioned with respect to base frame 18 to avoid interference with the backpack when backrest frame 22 pivots through the previously described arc about front edge of the seat. However, the stop means prevents the backrest frame from pivoting about the rear edge of the seat. Thus, for example, the stop means may be formed of an end segment 30 joined to each frame side member 28 and located on the opposite side of the pivot axis from the backrest cushion. The end segments 30 are bent acutely toward the centerline of the chair so that the end segments extend behind and engage the base frame when the backrest is fully upright. A segment 30 having a length of about one inch is suitably bent by an angle of about 30° to 45° to bring the end segment into a position where it will contact the base frame when the backrest is upright. Hence, the end segments are positioned to engage the base frame when the backrest is deployed in upright position.

In addition, each segment may be bent forward, as viewed in upright position in FIG. 2, in order to position the backrest at a preselected upright position. One desirable aspect of the lightweight chair is that the backrest is usefully positioned to provide support during erect seating activities, such as eating. For this purpose, the backrest is only slightly rearwardly angled from vertical when in upright position. A rearward angle of about 10° is close to ideal. With a chair frame of the type illustrated, which is a camp stool or scissors frame, such a slight forward bending of the truncated ends 30 produces the desired supporting position. Bending the end segments, as contrasted to bending the elongated standards 28, has further advantage when the chair is in collapsed configuration. Then the bent ends curve rearwardly toward the backpack and do not interfere with the comfort of backpacking activity.

The stop means is offset from the backpack 12 by a sufficient distance that the backrest frame 22 does not substantially interfere with the backpack 12 when pivoting between seating position and backpacking positions. Such non-interference can be achieved by offsetting the backpack from the chair and stop means either laterally or longitudinally. In the embodiment of FIGS. 1 and 2, the offset is lateral. Truncated ends 30 of the opposite side members 28 are separated by predetermined spacing between the truncated ends. The spacing is narrow enough that the ends engage, strike, or hook the chair frame to serve the stopping function. However, the spacing is wide enough that the bridge 16 and backpack 12 can substantially clear the opening. Thus, when the backrest is folded down and, in turn, the ends 30 pivot up, the ends 30 by-pass the bridge and backpack, thereby allowing the backrest to fold to downward position. Hence, a predetermined spacing between the end segments is substantially at least the width of the bridge, allowing the end segments to laterally bypass the bridge when folded forwardly from seating position to backpacking position.

Figure 3:
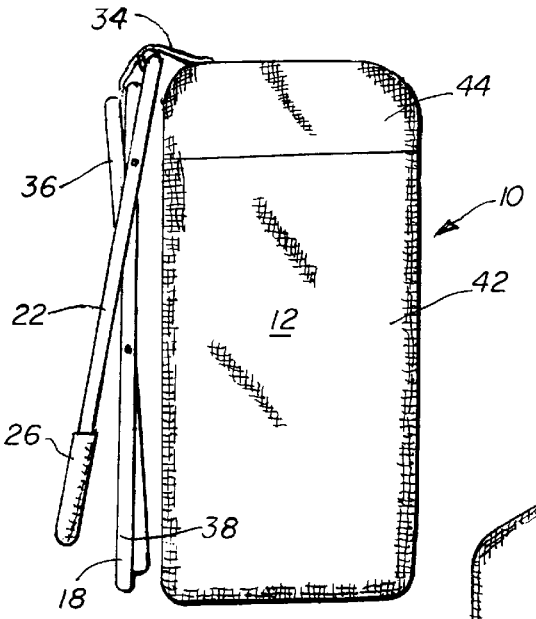
FIG. 3 is a side elevational view of a second embodiment of the combined chair and backpack, showing a modified backrest and bridge in backpacking configuration.
Figure 4:
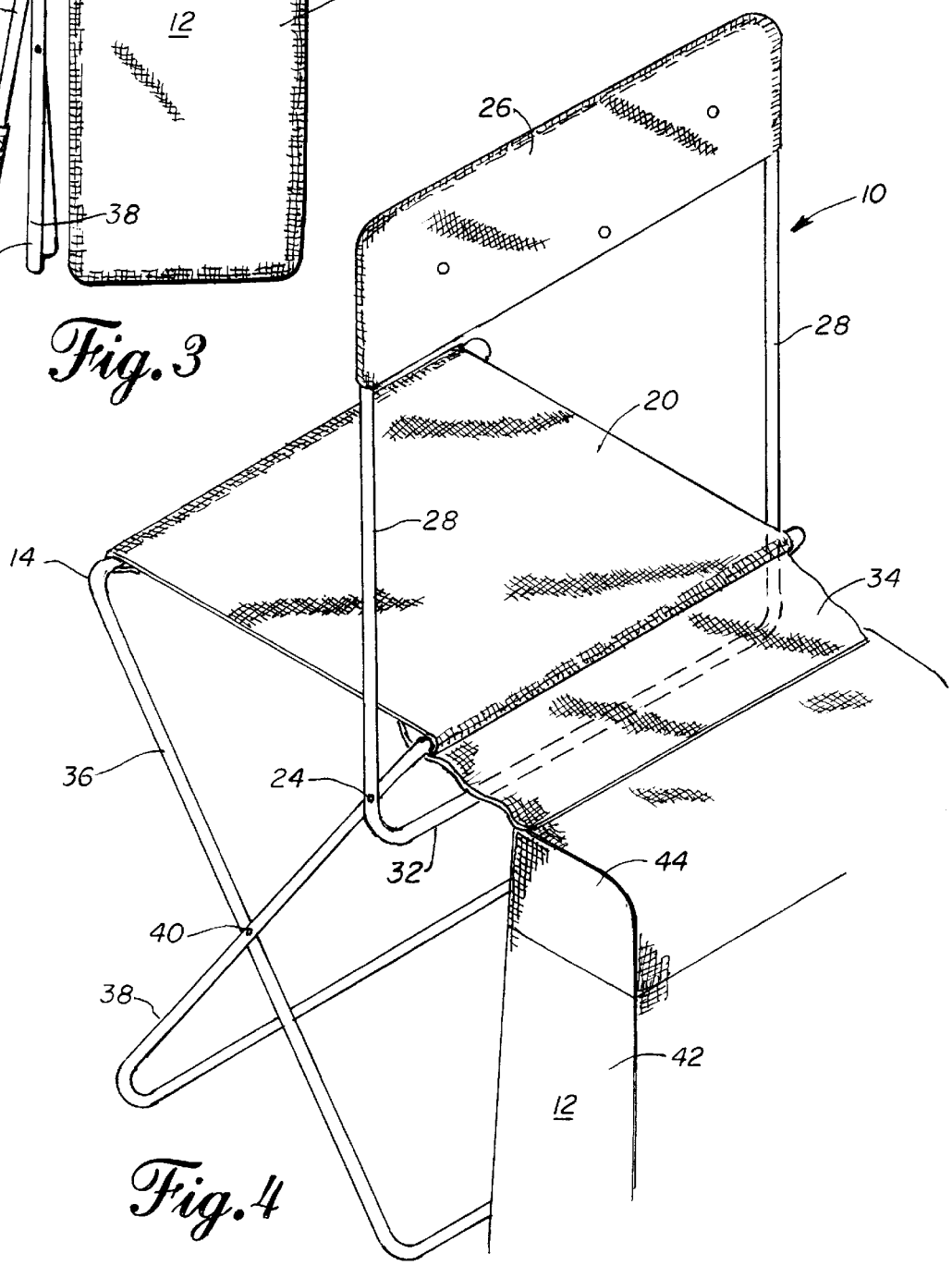
FIG. 4 is an isometric view of the combined chair and backpack of FIG. 3, showing seating configuration.

In FIGS. 3 and 4, the stop means is offset from the backpack in a longitudinal or front-to-back spacing. The stop means in this embodiment is a transverse bar 32 interconnecting side members 28 near the pivot axis. Bar 32 can be viewed as an interconnection of the end segments 30 of the prior embodiment. Since the bar is continuous between the side members, it will strike the chair base frame and provide a stopping function. If desired in order to modify the rearward angle of the backrest, the bar can be brought forward from the remainder of the frame by bending the side members forward, as shown and described for ends 30 in FIG. 2. The bar provides increased strength and rigidity to the chair and backrest frame, while maintaining efficient construction and light weight.

The front-to-back offset between the stop means and the backpack in the embodiment of FIGS. 3 and 4 is achieved by providing a bridge 34 of greater length than bridge 16. Transverse bar 32 may be positioned to pass outside and above the collapsed chair frame 18, as shown in FIG. 3, lifting and deforming the bridge 34, which is of sufficient length to pass over the transverse bar without damaging or substantially deforming the backpack 12. When the chair is fully collapsed as shown in FIG. 3, bar 32 is closely juxtaposed to the chair frame and requires little extra accommodation in the bridge length. However, at intermediate points of the folding process, the transverse bar 32 extends longitudinally rearwardly, or in the direction of the backpack, by a greater amount. The extra bridge length is desirable to minimize interference and wear on the rear face of the backpack during intermediate portions of such folding.

The backpacking configuration of the combined chair and backpack is best shown in FIGS. 1 and 3. The backrest positions the cushion 26 near the bottom of the backpack or folded chair frame. The pair of elongated side members 28 are of a suitable length to support the cushion in a position spaced below the pivot axis, where the cushion provides padded support both against that backpack and against the user's back. Typically, the backpack is worn with the cushion low on the back, where the cushion dissipates pressure of the load.

More specifically, the preferred position of the cushion 26, when the base frame is in collapsed position, is in front of the base frame. The folded or collapsed height of the frame from its bottom to the pivot axis 24 is a known or first predetermined distance. The elongated side members 28 of the backrest frame carry the backrest cushion 26 at a second known or predetermined distance from the pivot axis. The folded position of the cushion with respect to the collapsed frame is selected by establishing suitable values for these first and second predetermined distances. Thus, when the backrest cushion is suitably positioned in downward position to rest against the front of the collapsed base frame, the cushion 26 insulates contact between base frame 18 and the wearer's back.

The chair base frame 18 is of collapsible or foldable design, so that the chair and backpack are convertible between uses without disassembly and without the possibility of lost parts. An efficient, reliable, and easily manipulated frame is a scissors frame 18 as illustrated in the drawings, constructed of first and second closed, rectangular frame members 36, 38, joined at a central pivot 40. In deployment the first frame member 36 pivots relatively forward at its top and rearward at its bottom, while the second frame member 38 pivots relatively rearward at its top and forward at its bottom. For compactness when the frame is collapsed or folded, the first frame member may have a smaller size than the second such that the first frame member is capable of fitting within the second when in collapsed position, disposed substantially in a single plane.

The seat 20 is formed of flexible sheet material, such as a cloth material, and is joined between the top bars of the frame members 36, 38. For example, the cloth seat may be looped around each frame member and sewn, capturing each frame member in a cloth tube. The seat fabric limits the deployment of the frame. When the deployed chair is used, the weight of the user urges the frame to deploy further and places the seat fabric in tension, thereby providing comfortable support. The backrest frame 22 is joined to the chair frame on pivot hinge 24, located on second frame member 38. The elongated side members are positioned laterally outside the second frame member.

Figure 5:
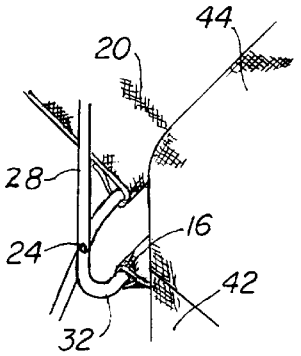
FIG. 5 is a fragmentary view of a third embodiment of the chair and backpack, showing an interconnecting bridge to the backrest frame.

Backpack 12 is connected to the rear of the chair by a bridge 16, 34, which may be formed of a fabric or other flexible sheet material. The connection of the bridge to the chair may be at the rear edge of seat 20. One suitable way of forming shorter bridge 16 is to provide a suitably sized loop of seat fabric around frame member 38 and to sew an edge of the loop into a seam of the backpack. In the alternative, the longer bridge 34 may be formed of a length of fabric connected to the seat, extending rearwardly from it, and sewn to the backpack. FIG. 5 shows still another bridge that employs a loop of fabric sewn to the backpack and passing around bar 32 of the backrest frame. In a backpack 12 of the style having a satchel body 42 and a lid 44 as illustrated in the drawings, a suitable joining point for any of these bridges is a seam at the junction of the backpack's lid 44 and body 42, facing the chair frame 18.

In a preferred construction, the backrest 26 is formed of a frame 22, which is a U-shaped tubular metal frame covered with a fabric hood. Foam padding is placed around the top bar of the back support to cushion the metal frame on both front and rear faces. The chair base frame 18 is formed by two planar, closed tubular metal base frames 36, 38 each having right and left side members and top and bottom end members. Frame 36 is sized to nest in the center opening of frame 38 when collapsed. The base frames are pivotally joined to each other near the centers of the corresponding side members by a pivot pin hinge 40. A fabric seat 20 is sewn to the top end members of the base frame in the traditional camp stool structure.

Frame 38 serves multiple purposes when the chair is deployed in seating mode. The backrest is preferred to be joined to the top bar of base frame 38 that defines the top rear of the chair. The backrest is pivotally attached to it at two pivot pin hinges 24. Each hinge 24 is located near the junction of a side member and the top bar. The backrest frame extends below the hinges 24 at each side, forming stop members 30, best shown in FIG. 1 and 2, that limit the rearward position of the backrest at a predetermined angle by striking frame member 38.

The chair frame 18 serves additional functions when the chair is stored and the backpack is in use. The backpack is attached via bridge 16 to the chair along the top bar of frame member 38. The fabric seat 20 and top of the backpack are sewn together to form bridge 16, which is connected to frame member 38. A hand carrying handle 46 is joined to the backpack at the junction with either bridge 16 or 34. In use, handle 46 is brought forward through the center openings of the frame members 36, 38, and raised in front of the top bars of these members. When the chair and backpack combination is hand carried, the handle 46 lifts both the chair and backpack while also holding shut the stored chair frame.

A pair of fastening straps 48, best shown in FIG. 1, are attached to the backpack at the bridge connection, near the top end of rear frame member 38, with one portion of each strap extending from the top side of the bridge and the mating portion extending from the bottom side of the bridge. These straps can be used to fasten shut the chair frame for storage or carrying, as well as to attach any sort of peripheral items such as a tent, sleeping bag, or jacket.

Chair frame member 38 carries one or more rings or loops 50 on each side member near its bottom bar. These rings connect a harness and other accessories used in backpacking mode. The backpack also employs the top bar of chair frame member 38 as a top support. As shown in FIG. 1, padded, adjustable shoulder harness straps 52 extend from the top of the pack at the bridge attachment, adjacent to frame member 38. The harness supports and balances the pack. The lower ends of the harness straps are fastened to the chair frame by adjustable straps 54, FIG. 2, that extend from rings 50 on frame member 38. A waist strap 56, FIGS. 1 and 2, attaches to rings 50 and allows the bottom of the backpack, via the chair frame, to be secured to a user. Straps 58 tie the bottom of the backpack to the lower end of chair frame 18 at member 36. The use of closed chair frame members 36, 38, is a particular advantage for retaining engagement with the backpack, since a shifting load may cause straps to move, but they will not slip off the frame members. Thus, when in backpacking configuration, the chair frame provides a secure and reliable fastening and supporting framework for the backpack.

The pack may include many optional features that contribute to its utility, such as the lid or rain flap 44 with a suspension enclosure, closed by straps. Inside the pack, a fabric mouth has a draw string closure. One side of the pack may carries a side long pocket, while the other side carries a similar pocket with pencil holders on its exterior face. The rear of the pack carries a back pocket and water bottle pocket.

The invention contemplates that the backpack and chair frame may be constructed of any suitable materials now known or hereafter developed. Further, the configuration of the backpack, its various pockets, flaps, closures, and harnesses can be varied to suit specific requirements and preferences. The shape of the chair and its frame can be altered, such as to contour the frame in an ergonomic fashion for seating or for user back support when the backpack is deployed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

I claim:

1. A convertible chair and backpack, comprising:

(a) a backpack;

(b) a chair convertible between a seating configuration and a backpacking configuration, and having front and rear edges defined when in seating configuration; and (c) a bridge of predetermined width connecting said backpack and said chair at the rear edge of the chair and positioning the backpack rearwardly of the chair in seating configuration;

wherein said chair comprises:

a chair seat and base frame moveable between a collapsed configuration suitable for backpacking and a deployed configuration suitable for seating;

a chair backrest frame carrying a backrest cushion near a longitudinal end of the backrest frame, connected to the base frame on a pivot axis, selectively pivotable thereon for movement between an upright position for seating and a downward position for backpacking, the backrest frame including a pair of elongated side members, one on each lateral side of the chair base frame, extending longitudinally between said pivot axis and said backrest cushion, wherein in downward position the backrest frame positions the backrest cushion on an opposite side of the chair frame from the backpack, for providing a cushioned back support between a wearer and the backpack for backpacking use;

a stop means for limiting upward pivotal movement of the backrest frame with respect to the base frame at upright seating position, wherein the stop means is offset from the backpack by a sufficient distance that the backrest frame is pivotable between upright position and downward position without substantial interference with said backpack, and wherein the stop means comprises an end segment of each side member of the backrest frame, longitudinally positioned on an opposite side of the pivot axis from the backrest cushion, defining a predetermined lateral spacing between end segments that is substantially at least the predetermined width of the bridge, allowing the end segments to laterally bypass the bridge when folded forwardly from upright position to downward position.

2. The convertible chair and backpack of claim 1, wherein:

said stop means is positioned with respect to said base frame allowing the backrest frame to pivot through an arc about the front edge of said seat.

3. The convertible chair and backpack of claim 1, wherein:

said stop means is positioned with respect to said base frame preventing the backrest frame from pivoting through an arc about the rear edge of said seat.

4. The convertible chair and backpack of claim 1, wherein said end segments are positioned to engage said base frame when the backrest cushion is deployed in upright position.

5. The convertible chair and backpack of claim 1, wherein:

said side members are of a length positioning the backrest cushion near a bottom of said backpack when in downward position, and the backrest cushion covers both sides of the backrest frame for providing a cushioned support for carrying the backpack during backpacking use.

6. The convertible chair and backpack of claim 5, wherein:

in collapsed configuration a portion of said base frame extends a first predetermined distance below said pivot axis; and said elongated side members of the backrest frame carry the backrest cushion at a second predetermined distance from the pivot axis;

wherein the first and second predetermined distances are such that the backrest cushion in downward position rests against a front side of the base frame in collapsed configuration, opposite from the backpack, and provides a padded insulation in front of the base frame during backpacking use.

7. The convertible chair and backpack of claim 6, wherein:

said chair base frame is a scissors frame having first and second closed frame members joined at a central pivot;

in deployed configuration the first frame member pivoting relatively forward at its top and rearward at its bottom; and the second frame member pivoting relatively rearward at its top and forward at its bottom;

the first frame member having a smaller size than the second frame member such that the first frame member nests within the second frame member when in collapsed configuration;

said seat is formed of flexible sheet material joined between the tops of the frame members; and said backrest frame is joined on a pivot hinge to the second frame member with said elongated side members positioned laterally outside the second frame member.

8. The convertible chair and backpack of claim 7, wherein:

said bridge is connected to the chair at said seat.

9. The convertible chair and backpack of claim 8, wherein:

said bridge is formed of flexible sheet material.

10. A convertible chair and backpack, comprising;

(a) a backpack;

(b) a chair with backrest, having a scissors base frame formed of first and second frame members selectively movable between collapsed and deployed configurations, and a seat of flexible sheet material joined between tops of the two frame members and limiting the deployment of the scissors base frame; and (c) a bridge of predetermined width, formed of flexible sheet material connecting said backpack to a rear of said chair;

wherein said chair backrest further comprises:

a backrest frame carried on one member of the scissors base frame on a backrest pivot axis for pivotal movement in a first direction for deployment to upright position for seating use and pivotal movement in a second and opposite direction for storage in a downward position for backpacking use;

a backrest cushion carried on the backrest frame near a longitudinal end of the backrest frame at a preselected distance from the backrest pivot axis such that when the backrest frame is stored in downward position, the cushion rests against a front face of said scissors base frame for providing a cushioned back support between a wearer and the backpack during backpacking use, and wherein the backrest frame includes a pair of elongated side members, one on each lateral side of the scissors base frame, extending longitudinally between said backrest pivot axis and said backrest cushion; and a stop member limiting pivotal movement of the backrest frame in the first direction when the backrest frame is in upright position, wherein the stop member is offset from the backpack by a sufficient distance that the backrest frame is pivotable between the upright position and the downward position without substantial interference with the backpack, and wherein the stop member comprises an end segment of each side member, longitudinally positioned on an opposite side of the backrest pivot axis from the backrest cushion, defining a predetermined lateral spacing between end segments that is substantially at least the predetermined width of the bridge, allowing the end segments to laterally bypass the bridge when pivoted in the second direction from the upright position to the downward position.

11. The convertible chair and backpack of claim 10, further comprising:

a flexible, hand carrying handle strap joined to the backpack below said bridge, of sufficient length to extend through said scissors base frame when in collapsed configuration and hold the scissors base frame in collapsed configuration when the collapsed chair and backpack are hand carried by a person.

* * * * *